US006512451B1

(12) United States Patent
Eslambolchi et al.

(10) Patent No.: US 6,512,451 B1
(45) Date of Patent: Jan. 28, 2003

(54) MANHOLE VEHICLE SENSOR

(75) Inventors: Hossein Eslambolchi, Los Altos Hills, CA (US); John Sinclair Huffman, Conyers, GA (US)

(73) Assignee: AT&T Corp., New York, NY (US)

( * ) Notice: Subject to any disclaimer, the term of this patent is extended or adjusted under 35 U.S.C. 154(b) by 0 days.

(21) Appl. No.: 09/660,687

(22) Filed: Sep. 13, 2000

(51) Int. Cl.[7] ..... B60Q 1/00

(52) U.S. Cl. ..... 340/425.5; 340/933; 340/943; 340/908.1; 340/539

(58) Field of Search ..... 340/933, 943, 340/908, 908.1, 686.6, 539, 540, 552, 556, 555, 331, 691, 693

(56) References Cited

U.S. PATENT DOCUMENTS 5,005,004 A 4/1991 Udofot
5,448,219 A 9/1995 Yoshikawa et al.
5,661,474 A * 8/1997 Douglas ..... 340/940
5,684,473 A 11/1997 Hibino et al.
5,733,063 A 3/1998 Bailey et al.
5,875,105 A 2/1999 Kim

* cited by examiner

*Primary Examiner*—Daryl Pope

(57) ABSTRACT

A utility worker seeking to exit a manhole (13) in a roadway (14) receives a warning of an approaching vehicle (12) via a warning device (18) within the manhole and signaled from at least one vehicle-detecting device (15) on the roadway for detecting approaching vehicles. The vehicle-detecting device (15) includes a motion detector (19) for detecting the approaching vehicle by its motion and, preferably, a noise detector (20) and band pass filter (22) for detecting the approaching vehicle by its motion. The motion detector (19) provides a "far end" or early warning of an approaching vehicle, whereas, the combination of the noise detector (20) and filter (22) provide a "near-end" or late warning. The combination of near-end and far-end warnings increases the margin of safety afforded the worker seeking to exit the manhole onto the roadway, in contrast to a far end or near end warning by itself.

15 Claims, 2 Drawing Sheets

MANHOLE VEHICLE SENSOR

TECHNICAL FIELD

This invention relates to a technique for sensing a vehicle approaching a roadway opening (i.e., a manhole) to alert a worker upon exiting the manhole of oncoming traffic.

BACKGROUND ART

Many utilities, including telecommunication service providers such as AT&T, bury their pipes and cables (hereinafter, "utility conveyances") underground, especially in urban environments, both for reasons for safety and esthetics. Utility workers typically gain access to such buried conveyances through an opening (i.e., a "manhole") in a roadway that leads into a utility vault through which such buried conveyances run. Prior to entering a manhole, a utility worker will typically block a portion of the roadway to divert oncoming traffic to protect workers entering and leaving the manhole. In this regard, some utilities and telecommunications carriers such as AT&T have detailed safety procedures that specify the proper placement of safety cones, warning signs, and even a company vehicle, to divert traffic from the manhole.

Despite such safety procedures, workers that enter and exit manholes in high traffic areas must remain vigilant to the danger of oncoming traffic. Generally, a worker entering a manhole has a good opportunity, especially in daylight, to watch for oncoming traffic. In contrast, workers exiting a manhole generally have little ability to detect a passing vehicle without sticking their head through the manhole, thus risking injury. While in the utility vault, utility workers often remain oblivious to events occurring on the overlying roadway, especially the approach of an oncoming vehicle.

Various prior art techniques exist for detecting the presence of an approaching vehicle on a roadway. One such technique involves placing one or more pressure- actuated switches on the roadway such that an oncoming vehicle will trigger at least one switch, thereby actuating an alarm. To become effective, a utility worker must place the switches along the roadway a distance ahead of the manhole (as determined by the flow of traffic), requiring that the worker temporary block the roadway to effect such placement, which may prove difficult under heavy traffic conditions. If the switches are not placed sufficiently ahead of the manhole, then a worker seeking to exit the manhole may not have adequate warning of oncoming traffic to avoid injury.

Thus, there is need for reliable technique for providing a sufficiently timely warning to a worker exiting a manhole of an oncoming vehicle.

BRIEF SUMMARY OF THE INVENTION

Briefly, in accordance with a preferred embodiment, the present invention provides a method for warning a worker of an approaching vehicle before the worker exits onto a roadway from an opening (a manhole) in the roadway surface. A utility worker initiates the method by placing a vehicle-detecting device, typically having a distinctively colored housing, on the roadway surface such that the device lies adjacent to the likely path of approaching vehicles. Once placed on the roadway, the detecting device detects the motion of an object, such as a vehicle along the roadway. Additionally or alternatively, the detector may monitor for the noise emitted by an approaching vehicle to detect its presence. Upon detecting the vehicle, either by motion and/or by noise, the detecting device alerts the worker via a visual and/or audible warning delivered below ground so that the worker receives the warning before exiting through the manhole onto the roadway. Detecting the approach of a vehicle by monitoring for the vehicle motion provides a "far end" or early warning of an approaching vehicle, whereas monitoring for the vehicle noise provides a "near-end" or late warning when the vehicle is very close to the manhole. The combination of near-end and far-end warnings increases the margin of safety afforded the worker seeking to exit the manhole onto the roadway, in contrast to a far end or near end warning by itself.

DETAILED DESCRIPTION

Figure 1:
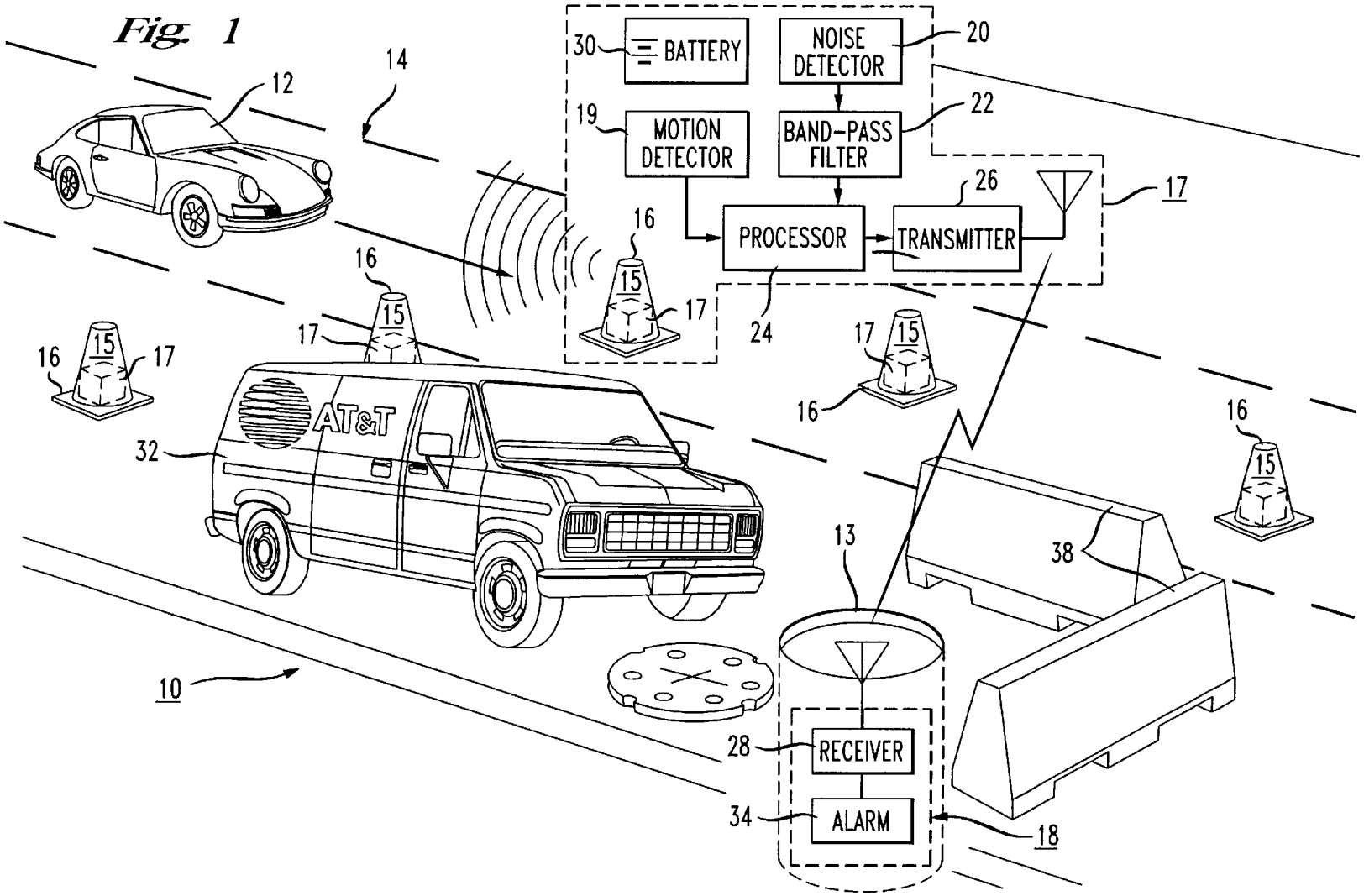
FIG. 1 is a block schematic of a vehicle-sensing device in accordance with a referred embodiment of the invention for warning a utility worker existing a manhole of an oncoming vehicle approaching a manhole in a roadway.

FIG. 1 depicts a warning system 10 in accordance with a preferred embodiment of the invention for detecting an oncoming vehicle 12 approaching an opening 13 (i.e., a manhole) in the surface of a roadway 14 and for alerting a worker (not shown) seeking to exit the manhole of the approaching vehicle. The system 10 includes at least one vehicle detector 15 having a distinctively colored housing 16, typically, although not necessarily, in the form of a fluorescent orange traffic cone. The cone 16 contains a vehicle-sensing electronics package 17 for sensing the approach of the vehicle 12. Also comprising part of the system 10 is a warning device 18 for placement in the manhole 13 to generate a warning in response to signals from at least one vehicle detector 15.

The vehicle-sensing electronics package 17 includes a motion detector 19 for detecting the motion of an object, such as the vehicle 12, as it approaches the traffic cone 16. In practice, the motion detector 19 may comprise an ultrasonic motion detector for directing a beam of energy, typically within the 2 kHz–100 kHz range to intersect at least a portion of the path traversed by the vehicle 12. The motion detector 19 detects the reflection of the energy from the approaching vehicle (e.g., vehicle 12) to detect its presence. Alternatively, the motion detector 19 could comprise a Radar system using radio frequency energy for detecting the vehicle presence.

The vehicle-sensing electronics package 17 may also include a noise detector 20 that is selectively actuated to detect ambient noise, including the noise emanating by the approaching vehicle 12. A band-pass filter 22 filters the noise detected by the noise detector 20 to filter all but the sound of the vehicle 12. In practice, a motor vehicle, such as vehicle 12, generates noise within a certain frequency range, and by appropriate selection of its frequency range, the filter 22 can pass the noise from the vehicle while blocking other noise.

A processor 24 receives the output signal from the motion detector 19 and may selectively receive the output signal of the band-pass filer 22. Using at least the signal from the motion detector 19 or the output signal of the filter 22, or preferably, by using both signals, the processor 24 determines whether the vehicle 12 is sufficiently close to the manhole 13 to warrant a warning. If the vehicle 12 is within a prescribed distance of the manhole 13, the processor 24 signals the warning device 18 situated within the manhole to generate a warning to the worker of the approaching vehicle. Typically, the processor 24 signals the warning device 18 via RF signals generated by a transmitter 26 for receipt by the warning device 18. However, the processor 24 could signal the warning device 18 through a hard-wired connection provided via a cable (not shown).

The vehicle-sensing electronics package 17 typically includes a rechargeable battery 30 for supplying power the various elements within the package requiring energy. As an alternative to the battery 30, the electronics package 17 of the detector 15 could receive electrical power from an on-site generator (not shown) or from the electrical system of a service provider truck 32 parked on the roadway 14 near the manhole 13 to divert traffic therefrom.

While the motion detector 19 may itself be sufficient to detect the approaching vehicle 12, selectively monitoring for vehicle noise, via the noise detector 20 and band-pass filter 22, in combination with vehicle motion detection affords a greater margin of safety. By itself, the motion detector 19 enables the vehicle-sensing electronics package 17 of the vehicle detector 15 to provide a "far-end" or early warning of the impending approach of the vehicle 12 when the vehicle is some distance away from the traffic cone 16. Conversely, monitoring the vehicle noise provides a "near-end" or late warning when the vehicle 12 is close to the traffic cone 16.

The warning device 18, which is situated in the manhole 13 to warn a worker prior to exiting onto the roadway, includes a RF receiver 33 for receiving RF signals generated by the transmitter 26 of the vehicle-sensing electronics package 17. Upon receipt of a warning signal from the transmitter 26, the receiver 33 signals an alarm 34 to generate a warning. (In the event that the vehicle-sensing electronics package 17 is "hard-wired" to the warning device 18 via a cable or the like, the receiver 33, as well as the transmitter 26, become unnecessary, whereupon the processor 24 would drive the alarm device 34 directly.)

The alarm device 34 may comprise any well-known mechanism for generating either an audible or visual warning or both. For example, the alarm device 34 could comprise an audio oscillator and speaker, a siren, or similar such mechanism for generating an audible warning. Alternatively, the alarm device 34 could comprise a light bulb, strobe light, light-emitting diode, or similar mechanism for generating a visual warning. Indeed, the alarm device 34 could comprise a combination of sound-generating and light-generating mechanisms for generating both an audible and visual warning.

The warning device 18 typically includes a rechargeable battery 36 for supplying power the various elements within the device requiring energy. As an alternative to the battery 36, the warning device 18 could receive electrical power from an on-site generator (not shown) or from the electrical system of the truck 32.

Figure 2:
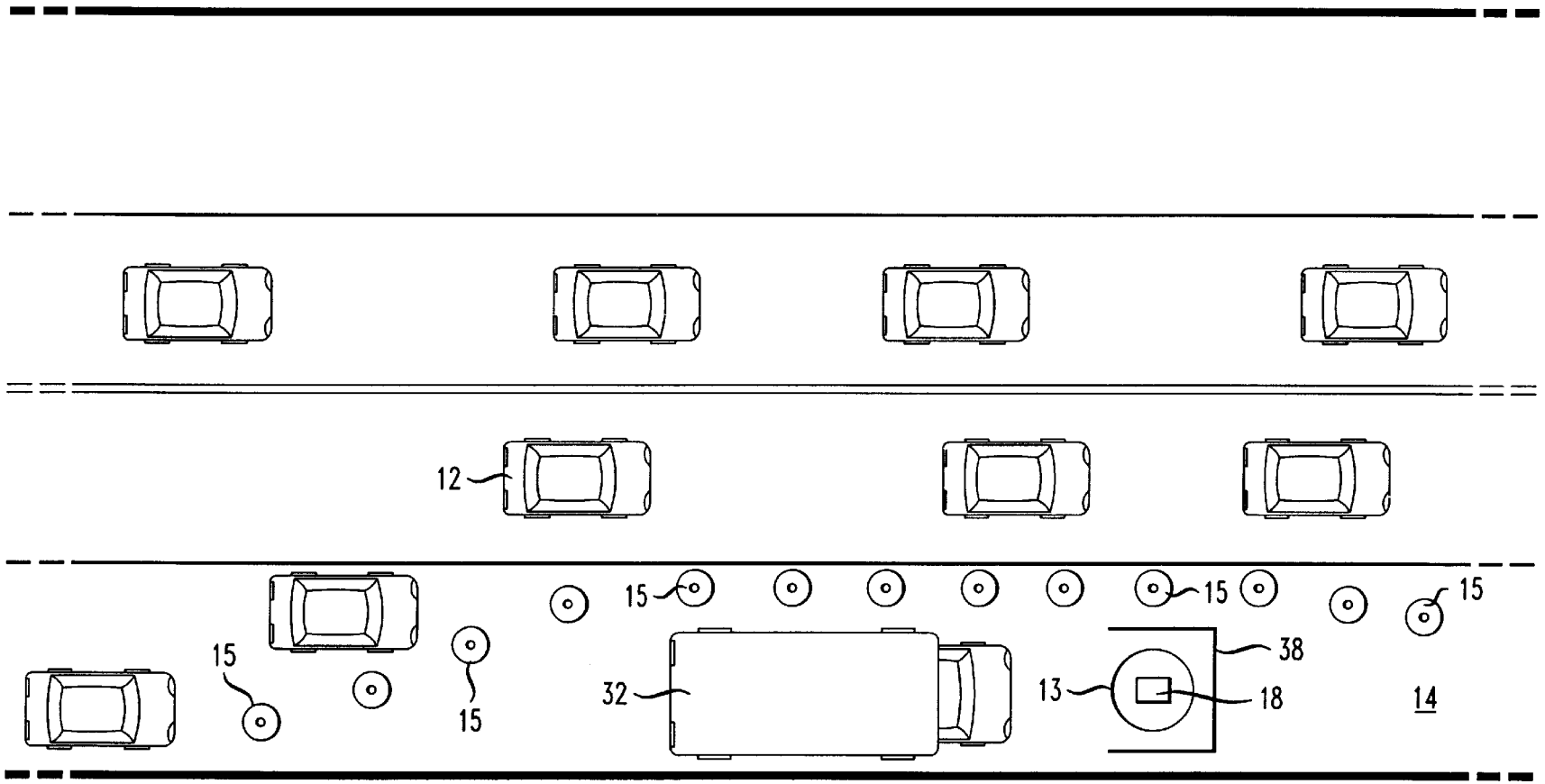
FIG. 2 depicts a plan view of a roadway to illustrate the manner in which a plurality of the vehicle-sensing devices depicted in FIG. 1 are positioned adjacent to the path on an approaching vehicle to detect its presence prior to approaching a manhole in the roadway surface.

Referring to FIG. 2, a utility worker seeking to enter the manhole 13 in the roadway will typically first position the truck 32 directly ahead of the manhole 13 (as determined by the traffic flow) to divert traffic away from the manhole. Thereafter, the worker will position at least one, and typically a plurality of traffic safety cones 16 on the roadway ahead of the truck 32 in spaced relationship with each other to divert the traffic around the truck and away from the manhole 13. Next, the worker will position a guard 38 to partially surround the manhole 13. Finally, the utility worker will take the warning device 18 into the manhole 13 to warn a worker exiting the manhole of any approaching vehicle.

In practice, a single warning device 18 has the capability to receive a warning signal from any of a plurality of vehicle-detecting devices 15. To that end, the transmitter 26 of each vehicle-sensing electronics package 17 of each vehicle-detecting device 15 transmits on the same frequency as the others so that the receiver 33 can receive the signal from any such vehicle-detecting device. Alternatively, the single warning device 18 may enjoy a hard-wired connection to several separate vehicle detecting devices 15. In this way, the worker within the manhole 13 can receive a warning from any of a multiplicity of vehicle detecting devices 15 while employing a single warning device 18. Thus, if for whatever reason, a first vehicle-detecting device 15 didn't detect a vehicle, then another vehicle-detecting device could alert the worker exiting the manhole.

The foregoing describes a technique for alerting a worker exiting a manhole onto a roadway of an approaching vehicle.

The above-described embodiments merely illustrate the principles of the invention. Those skilled in the art may make various modifications and changes that will embody the principles of the invention and fall within the spirit and scope thereof.

What is claimed is:

1. A method for warning a worker exiting an opening (manhole) in a roadway surface of an approaching vehicle, comprising the steps of:

placing at least one vehicle-detecting device along the roadway and spaced apart from a path traveled by the approaching vehicle;

placing a warning device within the manhole;

detecting, via the vehicle-detecting device, the approaching vehicle by detecting at least one of its noise and motion attributes;

determining the distance between the approaching vehicle and the manhole and comparing the determined distance to a predetermined warning distance; and, if the determined distance is less than the warning distance;

signaling the warning device within the manhole from the vehicle-detecting device on the roadway surface to cause the warning device to generate a warning to the worker attempting to exit the manhole in the roadway of the approaching vehicle.

2. The method according to claim 1 wherein the warning device generates an audible warning.

3. The method according to claim 1 wherein the warning device generates a visual warning.

4. The method according to claim 2 wherein the warning device generates a both a visual and an audible warning.

5. The method according to claim 1 wherein multiple vehicle-detecting devices are placed on the highway in spaced relationship ahead of the manhole.

6. The method according to claim 1 wherein the warning device is signaled from the vehicle-detecting device via RF signals.

7. The method as defined by claim 1 wherein the detecting step includes the step of detecting the motion of an approaching vehicle.

8. The method as defined by claim 7 wherein an ultrasonic motion detection process is used.

9. The method as defined by claim 7 wherein a radio frequency-based Radar motion detection process is used.

10. The method as defined by claim 7 wherein the detecting step includes the step of detecting the noise associated with an approaching vehicle.

11. A system for warning a worker exiting an opening (manhole) in a roadway surface of an approaching vehicle, comprising at least one vehicle-detecting device having a distinctively-colored housing for placement on a roadway ahead of the manhole to detect an approaching vehicle, said vehicle-detecting device for detecting at least one of the noise and motion attributes of an approaching vehicle and including a processor for receiving the detected attributes and determining the distance between the approaching vehicle and the manhole, said vehicle detecting device for generating a warning signal when the distance is within a predetermined limit; and a warning device for placement in a manhole and responsive to the warning signal from the vehicle-detecting device to cause the warning device to generate a warning to a worker seeking to exit the manhole.

12. The method according to claim 11 wherein the warning device generates an audible warning.

13. The method according to claim 11 wherein the warning device generates a visual warning.

14. The method according to claim 11 wherein the warning device generates both a visual and an audible warning.

15. The system according to claim 11 including a plurality of vehicle warning devices placed on the highway in spaced relationship ahead of the manhole.

* * * * *